United States Patent [19]

Grzych

[11] Patent Number: 4,700,894

[45] Date of Patent: Oct. 20, 1987

[54] FIRE NOZZLE ASSEMBLY

[76] Inventor: Leo J. Grzych, 8850 Parrish St., Schererville, Ind. 46375

[21] Appl. No.: 881,814

[22] Filed: Jul. 3, 1986

[51] Int. Cl.[4] ..... B05B 1/14

[52] U.S. Cl. ..... 239/555; 239/558; 169/70

[58] Field of Search ..... 239/556, 558, 560, 554, 239/555, 559, 567, 601; 169/54, 52, 70

[56] References Cited

U.S. PATENT DOCUMENTS

| | | | |
|---|---|---|---|
| 909,654 | 1/1909 | Oliver | 239/560 |
| 1,506,414 | 8/1924 | Dashew | 239/558 |
| 1,890,156 | 12/1932 | Konig | 239/554 |
| 2,481,074 | 9/1949 | Brown | 239/567 |
| 2,699,216 | 1/1955 | Allen | 169/70 |

FOREIGN PATENT DOCUMENTS

| | | | |
|---|---|---|---|
| 325662 | 9/1919 | Fed. Rep. of Germany | 239/555 |
| 398897 | 10/1922 | Fed. Rep. of Germany | 239/555 |
| 820345 | 9/1951 | Fed. Rep. of Germany | 239/559 |
| 158331 | 1/1921 | United Kingdom | 239/555 |
| 604003 | 6/1948 | United Kingdom | 239/555 |
| 1202040 | 8/1970 | United Kingdom | 239/556 |

*Primary Examiner*—Kenneth J. Dorner

*Assistant Examiner*—Gerald A. Anderson

*Attorney, Agent, or Firm*—Hill, Van Santen, Steadman & Simpson

[57] ABSTRACT

There is disclosed herein a firefighting nozzle forming a generally sphere-like water spray pattern. The nozzle includes a coupler for coupling the nozzle to a water delivery hose. The nozzle also includes a plurality of rings for forming a spray-like pattern. The ring includes a central ring positioned generally transverse to the water flow direction. A first group of nested and conical rings is positioned rearwardly of the ring and the surfaces of all successively rearwardly positioned rings sloping increasingly rearwardly. A second group of nested and conical rings is positioned forwardly of the central rings. The ring surfaces of successively forwardly positioned rings sloping increasingly forwardly. Each of the rings in the first and second group have a plurality of substantially radial water directing and fog forming slots, each of which has angularly shaped corner surfaces for creating turbulence.

In addition, there is disclosed an elongated nozzle for extending the nozzle into a room or space. There is also disclosed a winch mechanism for remotely extending the nozzle to distant positions.

16 Claims, 9 Drawing Figures

FIRE NOZZLE ASSEMBLY

BACKGROUND OF THE INVENTION

This invention relates to firefighting equipment, and more particularly, to firefighting nozzle assemblies.

The standard firefighting nozzle is coupled to the end of a hose, held by a fireman and directs a stream of water substantially directly forward at the fire. The stream can be adjusted to provide some angular spreading. For example, see U.S. Pat. No. 2,871,059.

One problem with such a nozzle is that the spray pattern is principally forward and narrow and thus cannot reach all surfaces of a burning room. This is particularly a problem if access to the room is prohibited by flames, heat, or barred windows or doors. Furthermore, the water flow through the nozzle produces reactive forces which cause the hose to whip and to be difficult to handle.

Other systems produce a more wide angle spray, sometimes hemispherical. In some systems a fog is produced by streams of water from the nozzle impinging on each other. See patents such as U.S. Pat. No. 2,726,897, which discloses a plurality of angularly positioned sprayers on a head; U.S. Pat. Nos. 2,993,650 and 3,107,060, which disclose a fogging sprayhead where multiple fluid streams are formed at different angles; U.S. Pat. No. 2,235,285, which discloses a sprayhead having multiple water streams that impinge on each other; see also U.S. Pat. Nos. 2,647,800; and 196,055 discloses a spherical sprayhead for a fire extinguisher.

None of the fogging or multiple stream nozzles are commonly used in fighting fires, and the standard forwardly directed nozzle is being used.

It is the applicant's desire to provide a useful multidirectional firefighting nozzle which produces a fog-like spray.

It is another object to provide a nozzle which will produce a substantially spherical spray pattern.

It is a further object of this invention to provide a nozzle which is substantially neutral in terms of the handling forces so as to avoid a whipping action of said hose.

Furthermore, in fighting fires, it is also desirable to punch the nozzle through a wall, a ceiling, or a barred window in order to spray an entire room or space without the firefighter entering the room.

It is a further object of this invention to provide a nozzle assembly which can be inserted into a space, so as to spray the entire space without the firefighter entering the space.

These and other objects of this invention will become apparent from the following description and appended claims.

SUMMARY OF THE INVENTION

There is provided by this invention a nozzle assembly which can spray all six surfaces of a space or room by producing a substantially spherical spray or fog. This nozzle reduces the reactive forces so as to minimize whipping. The nozzle even sprays some water back onto the firefighter. Furthermore, the assembly includes a rigid elongated handle which permits the nozzle to be inserted or punched into and spray an entire room or space without the firefighter being in the space.

The nozzle includes a plurality of concentric rings which are generally transverse to the direction of flow. Each ring has a plurality of radial flow directing slots around the periphery of the ring for directing water flow from the nozzle. Each slot has angular corners which produce turbulence in the water stream, and thus a fog from the nozzle. The rings are conically-shaped and their surfaces are arranged angularly with respect to the direction of fluid flow with a center ring being substantially transverse to the flow direction. The rings between the hose and center ring slope toward the hose or rearwardly with increasing angular displacement, and the rings toward the nozzle end or forward of the center ring slope forwardly with increasing angular displacement. The precise number of rings and angular attitudes are selected along with slot dimensions to produce the desired spray pattern and distance as described hereinafter.

The nozzle is mounted at the end of a rigid tube, the length of which is selected to reach the center of a typical room without the firefighter being in the room. A coupling is provided in the handle to permit disassembly of the handle so as to permit the hose to turn corners, etc.

A winch system is also provided for use with a telescoping assembly for extending the nozzle toward a remote location or retracting the nozzle therefrom.

DESCRIPTION OF THE PREFERRED EMBODIMENT

Figure 1:
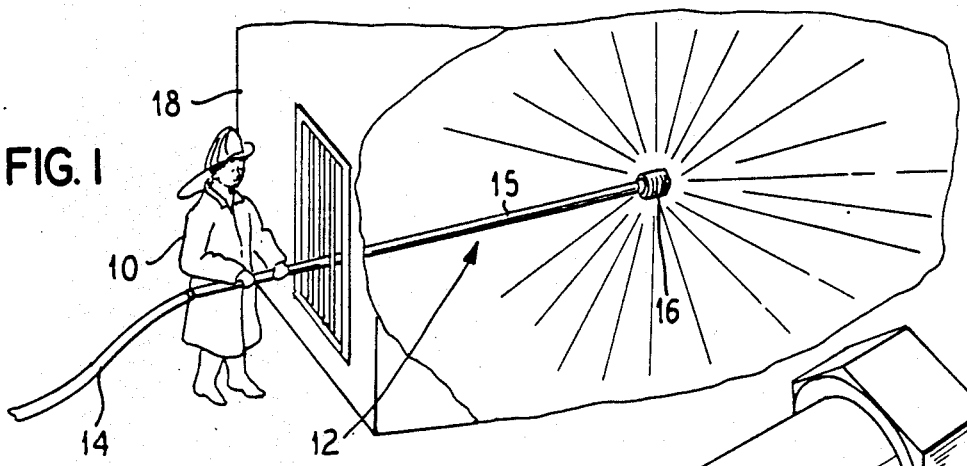
FIG. 1 is an elevational view showing a firefighter holding a hose and the nozzle assembly of this invention being positioned in a room or space.

Referring now to FIG. 1, a firefighter 10 is shown holding a nozzle assembly 12, which is connected at its inlet end to a fire hose 14.

The nozzle assembly 12 includes an elongated handle portion 15 and a nozzle or sprayhead 16 at the outlet end. In FIG. 1, the nozzle assembly is shown extended through a barred window into a room or space 18 with the spray nozzle at the center of the room and the firefighter outside the room. In the specific embodiment, the room may be 20 feet by 40 feet, the nozzle handle portion 14 feet long, and with the nozzle at the center of the room, the spray will reach all surfaces of the room.

In this embodiment, the nozzle will produce a 60-foot diameter spherical spray pattern at a pressure of 250 pounds per square inch at which about 450 gallons per minute are delivered.

Figure 2:
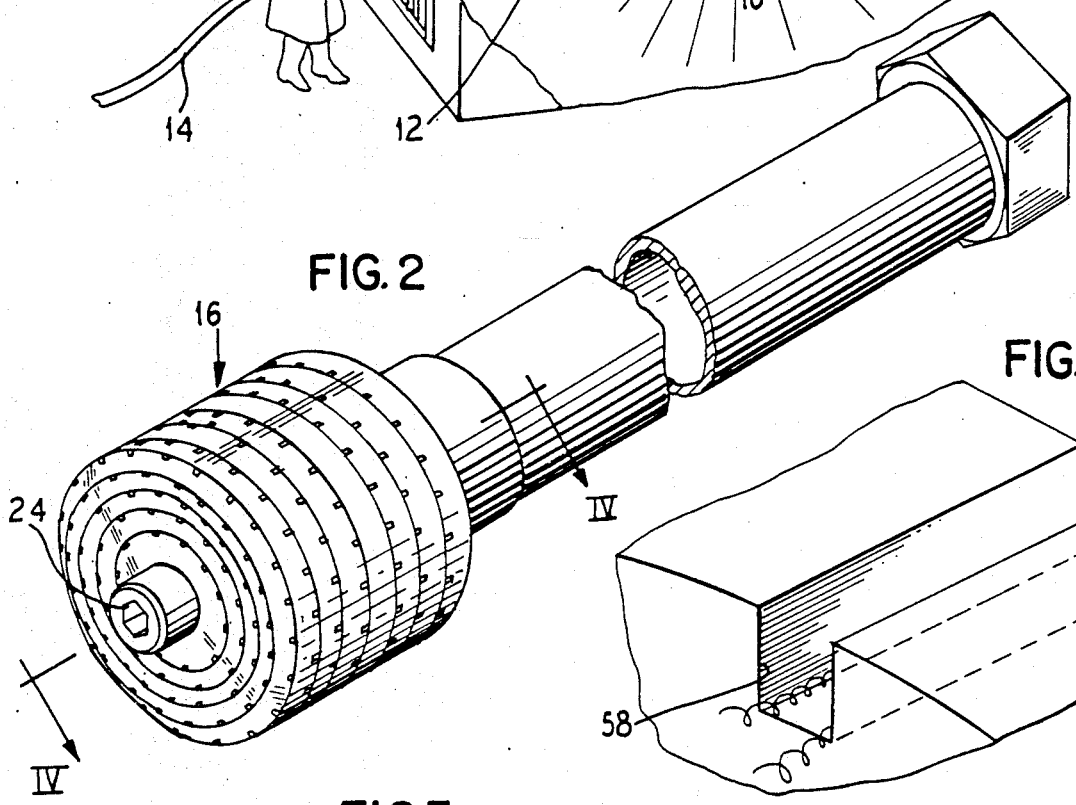
FIG. 2 is a perspective view of the nozzle assembly.
Figure 5:
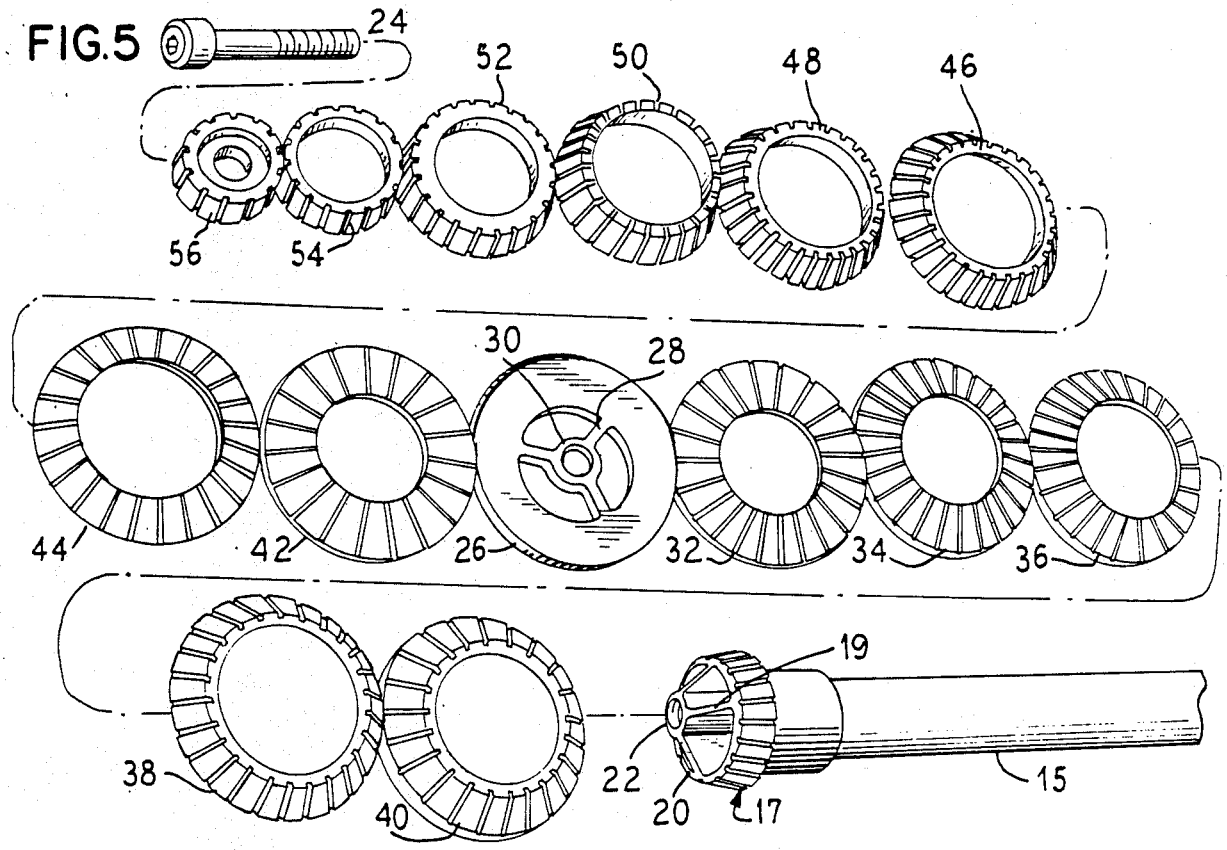
FIG. 5 is a plan view showing the individual rings for one nozzle assembly and the end of the rigid nozzle assembly handle or tube.

Referring now to FIGS. 2 and 5, the nozzle 16 is at the end of the tubular handle 15. The handle terminates in a nipple-like construction 17, which has a spider-like mounting construction that includes radially extending legs, such as 19 and 20, that meet to form an internally threaded nozzle mounting bore 22. A nozzle mounting bolt 24 extends through the nozzle rings and threadably engages the bore 22 so as to hold the nozzle onto the handle.

The nozzle assembly includes a plurality of rings with the center ring 26 being a flat member having an internal positioning spider 28 having a center bolt receiving and ring positioning bore 30.

The ring 26 is positioned at the center of the nozzle and transverse to the fluid flow therethrough. It is to be noted that both sides of the center ring are flat. The remaining rings are positioned forwardly and rearwardly of the center ring.

Figure 3:
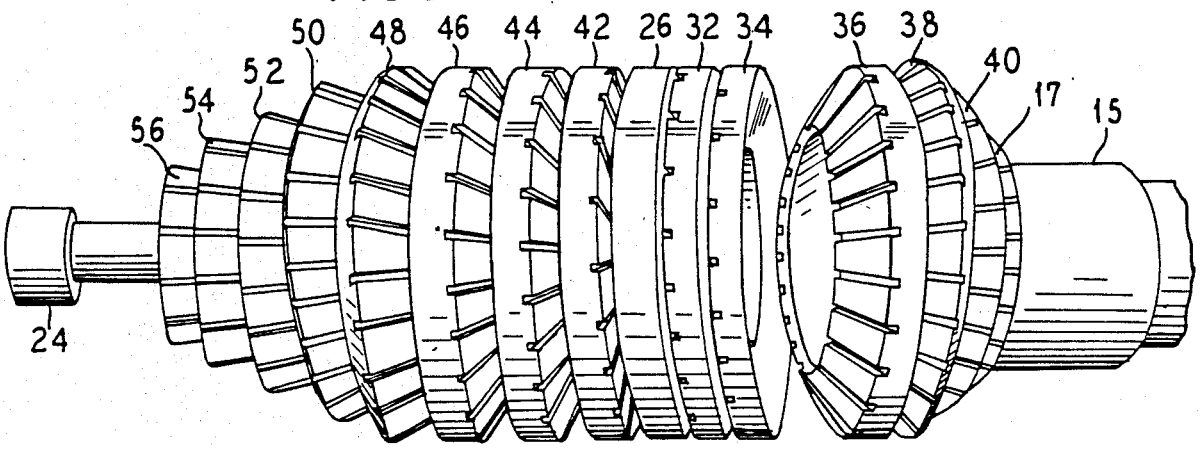
FIG. 3 is an elevational view of a partially assembled nozzle showing the concentric ring structure.
Figure 4:
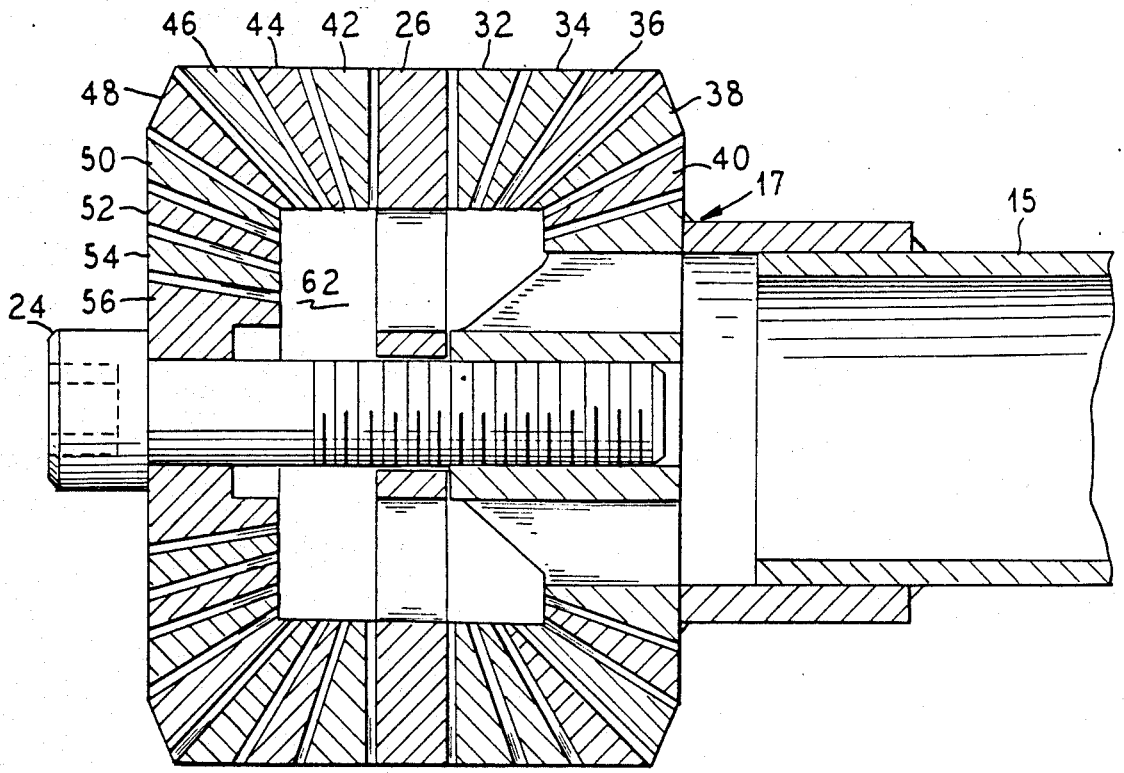
FIG. 4 is a sectional view along line IV—IV of FIG. 2 showing the nozzle assembly in cross-section.

There is shown five rearwardly positioned rings 32, 34, 36, 38 and 40, each of which are conically shaped, define a sloped surface with respect to the direction of water flow and nest against one another. The rearwardly positioned rings all slope rearwardly, and as seen in FIGS. 3 and 4, the slope or angular attitude of each ring increases with the ring's distance from the center ring. In other words, the slope of each successively rearward ring is greater than a prior ring.

Forwardly of the center ring, there is shown five (5) sloping rings 42, 44, 46, 48 and 50 and three (3) substantially cylindrically-shaped retaining rings 52, 54 and 56. The five (5) sloping rings slope forwardly from the center ring, in a manner analogous to the sloping of the rearward rings and also nest against one another. The cylindrically-shaped rings 52, 54 and 56 fit within the sloping rings and act as a retainer for holding the nozzle assembly together.

In order to assemble the nozzle, the rings are arranged as shown in FIGS. 2 through 5 and the bolt 24 is passed through the forwardmost ring 56, through the forward rings, through the bore 30 in the center ring, through the rearward ring, and is threaded into the threaded bore 22 in the end piece.

The rings are thus drawn together and nest or stack against one another.

Figure 6:
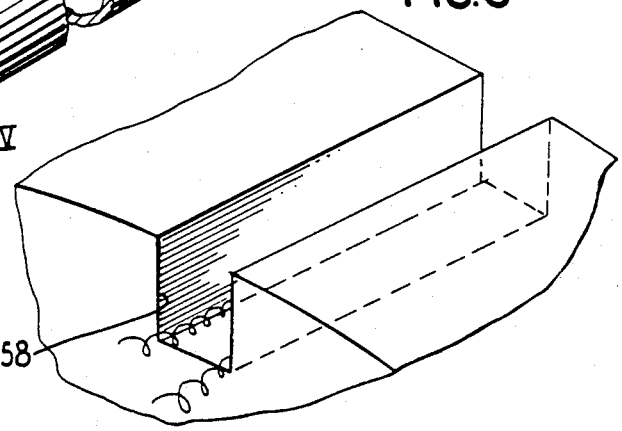
FIG. 6 is a cross-sectional view of one of the slots showing the square or angular corners therefor.

Most of the conically-shaped rings have a $3\frac{1}{2}$ inch outside diameter, $2\frac{3}{4}$ inch inside diameter, and $\frac{3}{4}$ inch land or annulus portion. Each of the conically-shaped rings and each of the cylindrically-shaped rings has a plurality of radially-extending slots for directing water flowing through the nozzle. Each of the slots, such as 58 shown in FIG. 6, are generally rectangular or channel-shaped in cross-section and include square corners. As shown, only one side of each ring is slotted so that the slotted surface rests against the flat surface of an adjacent ring to form a substantially square shaped flow path.

Water flowing through the slots exits as droplets and a fine mist. The mist forms as a result of turbulence at the slot corners and the droplets from water passing through the body of the slot.

It will be noted that the interior of the nozzle defines a water-receiving distribution chamber 62 which receives water from the hose and distributes water to the slots in the rings.

There are a number of variables which affect this invention. First, the number of rings is variable and are selected in relation to the expected pump pressure and the fullness and amount of mist desired in the spray. The spray becomes fuller and has more mist as the number of rings increases and, in general, as the pumping pressure increases.

The number of slots and slot dimensions can be varied. However, the slot must have square or polygonal corners, i.e., not circular corners. Wider and deeper slots and a longer annulus or land area will increase the spray distance.

It will be noted that the conically shaped rings define the spherical pattern and the cylindrical rings define the forward spraying distance. Thus the angular attitude of the rings can be adjusted to achieve the desired flow.

It has also been found that the slots permit free flowing of the water and longer spray distances. Drilled holes do not project the spray far enough.

Figure 7:
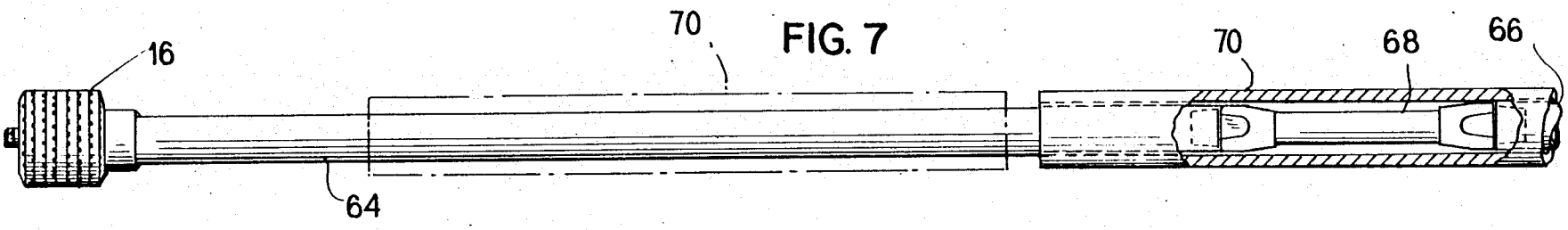
FIG. 7 is an elevational view showing sections of the nozzle handle separably coupled together.
Figure 8:
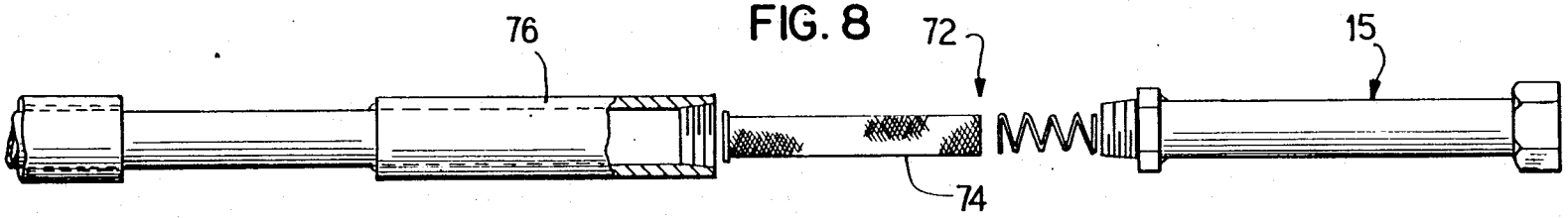
FIG. 8 shows a filter assembly.

In order to manipulate the nozzle asssembly in corridors, hallways and around corners, the tubular handle is in sections, such as 64 and 66, which are coupled by a section of hose 68 over which a slidable coupling sleeve 70 fits for movement between a coupled and uncoupled position as shown in FIGS. 7 and 8. Thus when it is necessary to turn a tight corner, the sleeve 70 can be slid to an inoperative position, the corner turned employing the flexibility of the hose 68, and then coupled back together.

FIG. 8 shows a cartridge-like filter assembly 72, which includes a flow-through filter cartridge 74, which is spring mounted in a housing 76 in line with the handle 15.

Figure 9:
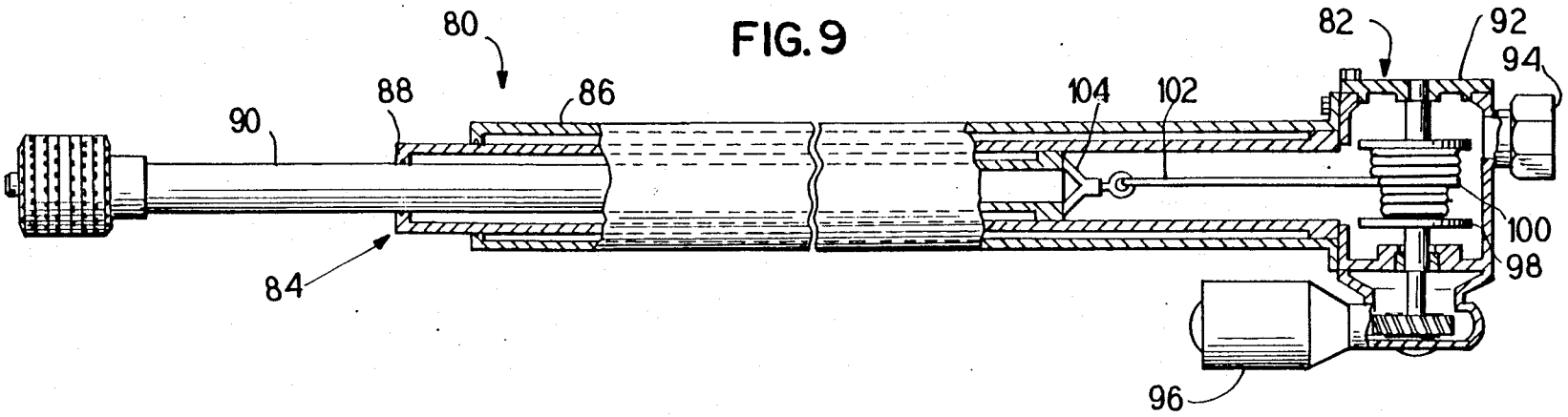
FIG. 9 is an elevational view of a telescoping winch system for inserting the nozzle into a space.

In another embodiment, the nozzle may be mounted at the end of a telescoping remotely controlled arm 80, which is sometimes referred to as a cherry-picker. As shown in FIG. 9, the device could include a winch 82 and an arm 84 formed from a series of nesting or telescoping sleeve segments, such as 86, 88 and 90. In the assembly the innermost sleeve 90 is also the furthest extensible sleeve. The winch 82 includes a flow-through, watertight housing 92 through which water flows from coupling 94, into the sleeve segments and to the nozzle 16. The winch also includes a drive 96 that is coupled to a cable winding spool 98, and one end 102 is secured to the innermost sleeve segment 90 by a Y-shaped coupler 104. In this manner the sleeve is pulled in a substantially straight line toward the spool and thus minimizes any twisting, tilting or cocking of the sleeve segments as they extend or retract. The cable 100 is wound about the spool 98. Using this system the nozzle can be extended into a room or building by remote control using such a telescoping arm system.

In operation, the winch is placed in a neutral or freewheeling position, the water is turned on and entering water pushes the innermost sleeve 90 outwardly and successively causes the other sleeves to extend so as to telescopingly extend the arm to its outermost position. In this situation the winch is freewheeling and the cable 100 freely extends with the arm. In order to retract the arm, the winch is activated to rewind cable 100 and thus draw the sleeve sections toward the winch. It will be appreciated that the nozzle can be positioned between the fully extended and fully retracted positions by simultaneously operating the winch and water so that the winch and water forces are balanced against each other in order to position the nozzle.

It will be appreciated that numerous changes and modifications can be made to the embodiment disclosed herein without departing from the spirit and scope of this invention.

I claim as my invention:

1. A nozzle for forming a generally sphere-like water spray pattern, said nozzle comprising:

means for coupling said nozzle to a water delivery hose for receiving water therefrom;

a plurality of rings for forming said spray pattern, which rings include:

a central ring positioned in a generally transverse attitude to the water flow direction;

a first group of nested and conically shaped rings positioned rearwardly of said central ring, the surfaces of successively rearwardly positioned rings sloping increasingly rearwardly;

a second group of nested and conically shaped rings positioned forwardly of said central ring, the ring surfaces of successively forwardly positioned rings sloping increasingly forwardly;

each of said first and second group of rings having a plurality of substantially radial water directing and fog forming slots, said slots having angularly shaped corner surfaces for creating turbulence; and retainer means securing said rings in stacked and assembled relation.

2. A nozzle as in claim 1, wherein in each ring said slots are formed on one side of said ring, which side abuts the unslotted side of an adjacent ring so as to form a closed water flow channel.

3. A nozzle as in claim 1, wherein said retainer means passes through said rings for retaining said rings in stacked and assembled relation and securing said assembled rings to a hose.

4. A nozzle as in claim 3, wherein said retainer means includes spider-like retaining means at said hose end of said nozzle and having a central bolt means receiving bore and bolt means extending from one end of said nozzle, through said rings and being received in the bore of said spider-like retaining means.

5. A nozzle as in claim 1, and in combination therewith, a rigid elongated tubular handle, said nozzle being mounted to said handle at one end remote from the coupling means.

6. A nozzle as in claim 1, wherein said slots define a square cornered channel.

7. A nozzle as in claim 1, wherein said central ring is substantially planar and includes a centrally positioned spider-like member having a central retainer receiving bore therein for axial positioning of said central ring.

8. A nozzle as in claim 1, wherein said rings define an internal water receiving chamber for receiving water from said hose and distributing water to said slots.

9. A nozzle as in claim 1, and in combination therewith, a telescoping arm assembly for positioning said nozzle, said assembly comprising:

an arm having a plurality of telescoping sleeve means adapted to move between an extended position and a retracted position;

said nozzle mounted to the end of the furthest extensible sleeve means;

winch means associated with said arm for moving said sleeve means from an extended position to the retracted position;

whereby said sleeve means are adapted to extend under the influence of water pressure therein and be retracted by said winch means.

10. A nozzle and telescoping arm assembly as in claim 9, wherein said winch means includes cable means connected to the furthest extensible sleeve means, whereby winding of said cable means by said winch retracts said furthermost sleeve means and causes said arm to telescopingly retract.

11. A nozzle and telescoping arm combination as in claim 10, wherein said winch includes a flow-through, watertight housing wherein incoming water flows through said housing to said telescoping arm, and said winch includes cable spool means mounted within said housing and cable means connected to said spool means and the furthest extensible sleeve means.

12. A nozzle as in claim 1, wherein said elongated handle means includes a pair of separable sections, a hose coupling section for coupling the separable sections in water receiving relation, and sleeve coupler means for releasably securing each of said separable sections to each other, so that said handle sections can be separated for maneuvering and coupled for use.

13. A nozzle as in claim 1, wherein the length, width and height of each of said slots is selected for controlling the distance and pattern of the spray in a predetermined manner.

14. A nozzle as in claim 13, wherein each of said rings includes at least twenty-four (24) slots.

15. A nozzle as in claim 1, wherein each of said first group and said second group of rings includes at least five (5) rings.

16. A nozzle as in claim 12, wherein each of said rings includes at least twenty-four (24) slots.

* * * * *